United States Patent [19]

Huffman et al.

[11] Patent Number: 4,836,167

[45] Date of Patent: Jun. 6, 1989

[54] ENGINE GOVERNOR FRICTION DAMPER AND METHOD

[75] Inventors: Paul F. Huffman, Ham Lake, Minn.; Ron L. Bardell, Mountain View, Calif.

[73] Assignee: Onan Corporation, Minneapolis, Minn.

[21] Appl. No.: 91,396

[22] Filed: Aug. 31, 1987

[51] Int. Cl.[4] ..... F02M 39/00

[52] U.S. Cl. ..... 123/376; 123/403; 123/337

[58] Field of Search ..... 123/376, 403, 337, 365, 123/364

[56] References Cited

U.S. PATENT DOCUMENTS

| | | | |
|---|---|---|---|
| 1,128,782 | 2/1915 | Hartford . | |
| 1,265,883 | 5/1918 | Church . | |
| 2,367,606 | 1/1945 | Olson . | |
| 2,533,180 | 12/1950 | Rhodes | 123/376 |
| 2,613,657 | 10/1952 | Sloane | 123/376 |
| 2,635,596 | 4/1953 | Adler | 123/376 |
| 2,716,397 | 8/1955 | Heinish | 123/376 |
| 3,276,439 | 10/1966 | Reichenbach | 123/376 |
| 3,666,057 | 5/1972 | Leifer et al. . | |
| 3,937,302 | 2/1976 | Palmerantz . | |
| 4,176,642 | 12/1979 | Shipinski . | |
| 4,355,611 | 10/1982 | Hasegawa . | |
| 4,530,334 | 7/1985 | Pagdin . | |

FOREIGN PATENT DOCUMENTS

| | | |
|---|---|---|
| 2528113 | 9/1983 | European Pat. Off. . |
| 58-200047 | 11/1983 | Japan . |
| 59-128936 | 7/1984 | Japan . |

*Primary Examiner*—Carl Stuart Miller

*Attorney, Agent, or Firm*—Merchant, Gould, Smith, Edell, Welter & Schmidt

[57] ABSTRACT

An engine/governor friction damper mechanism provides for a method of reducing hunting and searching in a governor controlled engine/generator set. The preferred method comprises a modification in a conventional arrangement utilizing a governor rod and pivotal connection with a crank arm on a throttle control assembly. Friction to pivotal movement of the governor rod with respect to the crank arm is provided by means of a spring-loaded friction washer member arrangement.

26 Claims, 3 Drawing Sheets

1/4 Rated Load
PRIOR ART

1/2 Rated Load
PRIOR ART

1/4 Rated Load

1/2 Rated Load

ENGINE GOVERNOR FRICTION DAMPER AND METHOD

TECHNICAL FIELD

The present invention relates to engines, in particular engines for use in power generator sets. More specifically, the invention concerns governor systems for such engines, and the provision of a damper mechanism to generally limit governor over-compensation and inhibit searching.

BACKGROUND OF THE INVENTION

Conventional generator sets have found a wide variety of uses. Typically, a generator set comprises and engine in association with a generator or generator mechanism, used to provide electrical power. Such systems are used, for example, to provide emergency power in homes and offices. Portable units are used to provide electrical power at work stations in the field and for recreational vehicles and the like.

Generally, the engine is spark-ignited, utilizing gasoline, natural gas, propane, diesel, or similar fuel. The engine is typically set to run at a preferred speed, usually defined in terms of the revolutions per minute (rpm) of the engine driveshaft. This speed is ordinarily determined by the rate at which the engaged generator must be driven, to efficiently produce power during a typical load.

During use, the load on the engine may vary considerably. This may occur as power drain on the generator is varied. For example, a load variation will occur as a power tool or appliance is turned on or off.

If a heavier load is placed on the engine, the engine will tend to slow down. The engine governor system or mechanism provides for a continual adjustment in engine speed in response to the load variations, to maintain a relatively constant engine speed. Generally this is accomplished through an adjustment in a throttle of the engine, i.e. air or fuel flow from or through the carburetor. Typically this is accomplished through adjustment of a butterfly valve or throttle plate. That is, should a greater load be placed on the engine, the throttle is adjusted somewhat in response to the concomitant decrease in rpm, allowing the engine to speed up. On the other hand, should a load suddenly be taken off an engine, the throttle is adjusted in an opposite manner, in response to the rpm surge, to slow the engine down.

The typical governor system includes a sensor mechanism which detects, either directly or indirectly, the rotation speed of the engine driveshaft or crank shaft. Through conventional governor linkage mechanisms including a governor member, the sensor typically communicates with a throttle control. A typical governor linkage mechanism includes a governor arm, as a governor member. The governor arm is linked to another governor member, a governor rod, which provides mechanical communication with the throttle control. In many conventional systems this occurs through mechanical connection to a pivotable rod on which a throttle plate is mounted. Rotation of the pivotable rod selectively orients the throttle plate to increase or decrease engine speed.

Such systems are well-known and will not be described in detail herein. However, generally, should the engine speed change, the governor sensor, in response to the change in engine speed, moves the governor member. Movement of the governor member typically causes controlled adjustment of the throttle, generally through a predicted pivoting of the throttle plate to adjust the engine speed back toward a desired norm.

Since the very earliest developments of governor systems, there have been problems of hunting or searching and over-compensation. That is, while attempting to return the engine speed to the normal, desired, speed, the governor usually over-compensates. As a result, the engine may speed up and slow down a number of times, before it finds the correct speed. This is typically referred to as "hunting" or "searching".

Searching is a problem, since it may lead to undesired power fluctuations and inefficient utilization of fuel. In the past, attempts to control hunting or searching have generally involved efforts to reduce to a minimum the amount of mechanical friction present in the governor linkage mechanism. This has generally led to an improvement in governor performance, partially due to a limitation in the amount that any given movable mechanical joint can unpredictably "stick". However, even reduced friction systems still undergo a substantial amount of undesired searching or hunting.

What has been needed has been a system and method for the reduction and/or control of undesired over-compensation leading to hunting or searching.

OBJECTS OF THE INVENTION

Therefore, the objects of the present invention are: to provide a method of reducing searching or hunting in governor controlled engine systems; to provide such a method comprising the utilization of a friction damper to limit the governor movement which causes over-compensation; to provide such a method which comprises the placement of a friction damper mechanism on a linkage in a governor mechanism; to provide such a method including placement of the damper mechanism at a linkage between a governor mechanism and a throttle control; to provide such a damper mechanism comprising a friction washer member operating under applied pressure from a biasing member to generate resistance to movement of an engine throttle control arm, due to the applied pressure; and, to provide such a damper mechanism which is relatively inexpensive to produce, easy to assemble and which is particularly well adapted for the proposed usages thereof. It is another object of this invention to provide a damper mechanism and method readily adaptable to control searching and over-compensation in a variety of conventional governor systems, with only a few modifications being necessary.

Other objects and advantages of this invention will become apparant from the following descriptions, taken in conjunction with the accompanying drawings wherein are set forth by way of illustration and example certain embodiments of the present invention.

SUMMARY OF THE INVENTION

According to the invention a friction damper is placed in a governor system, to resist movement of a portion of the governor mechanism and dampen throttle adjustment in response to changes in speed of the engine detected by a governor sensing mechanism. The mechanism generally comprises a friction damper, which resists adjustment of the governor mechanism, and thus the throttle, a certain, selected, amount. Otherwise, the damper permits the governor systems to adjust in a more or less conventional manner. It has been found that through the introduction of such a friction damper system, a substantial reduction in searching or hunting will occur.

The preferred friction damper mechanism according to the present invention is positioned at a juncture or linkage between a governor member and a mechanism which actuates throttle adjustment. Generally, the throttle adjustment mechanism comprises a link arm or crank arm pivotally mounted by an axle. The crank ar rotatably engages a governor rod, which generally linearly moves with respect to changes in engine speed detected by a governor sensing mechanism. Thus, as the governor rod moves, the crank arm is pivoted. Generally, the crank arm causes rotation of a shaft on which a throttle plate is mounted, to adjust the throttle and change engine speed.

In a preferred application of the present invention, the governor rod is circular in cross-section, with a lateral extension on one end which engages an aperture in the crank arm. The damper mechanism of the preferred embodiment comprises utilization of friction washer means mounted at the engagement between the governor rod and the crank arm. The friction washer means includes at least one washer biased plate against the crank arm and an extension or projection on the governor rod, to squeeze the linkage. As a result, a friction system is created to resist pivoting of the crank arm relative to the governor rod. By varying the amount of biasing pressure on the washer plate, a selected force can be created to appropriately dampen the system, while still permitting selected engine speed adjustment. The preferred damper mechanism includes a pair of washer plates with the crank arm positioned therebetween.

The drawings constitute a part of this specification, and include exemplary embodiments of the present invention, while illustrating various objects and features thereof. In some instances, relative material thicknesses an component sizes may be shown exaggerated, to facilitate an understanding of the invention.

DETAILED DESCRIPTION OF THE PREFERRED EMBODIMENT

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but rather as a basis for the claims and as a representative basis for teaching one skilled in the art to variously employ the present invention in virtually any appropriately detailed structure.

Figure 1:
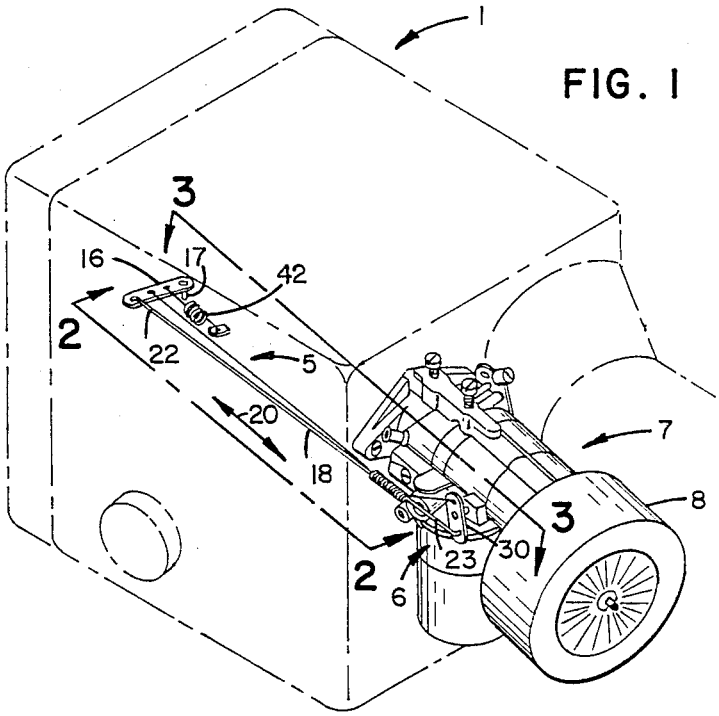
FIG. 1 is a fragmentary perspective view of an engine/generator set modified according to the present invention to include a friction damper mechanism in association with a governor system thereof; many of the components of the engine/generator set, not of immediate concern to an understanding of the friction damper mechanism, being shown in phantom lines.

The reference numeral 1, FIG. 1, generally designates an engine/generator set modified according to the present invention. The present invention may be utilized in association with a variety of systems involving governor-controlled engines, however it is particularly suited for use in engine/generator sets for electrical power production. The engine/generator set 1 may be of a variety of types and manufactures. Generally, the engine comprises an internal combustion engine, i.e., a spark-ignited engine, which utilizes gasoline, propane, natural gas, diesel fuel or similar fuels. As the engine is operated, a driveshaft is rotated, in a conventional manner, to drive the generator portion of the set 1. The generator, in a conventional manner, provides electrial power. It will be understood that the engine/generator set 1 may be portable, however there is no requirement that is be so.

The reference numeral 5, FIG. 1, generally designates the governor system, which provided mechanical communication between portions of the engine/generator set 1 not detailed, and portions of a throttle control system 6, FIG. 1. Typically, the throttle control system 6 is part of, or is closely associated with, a carburetor system 7.

In a conventional manner, the carburetor system 7 provides for a controlled mixing of fuel and air and introduction of the mixture into the engine. Air is generally introduced into the system via air filter 8, FIG. 1. The engine includes a throttle assembly 9, which may be of a conventional type, controlling engine speed by adjustment in orientation of a butterfly valve or throttle plate 10.

Figure 3:
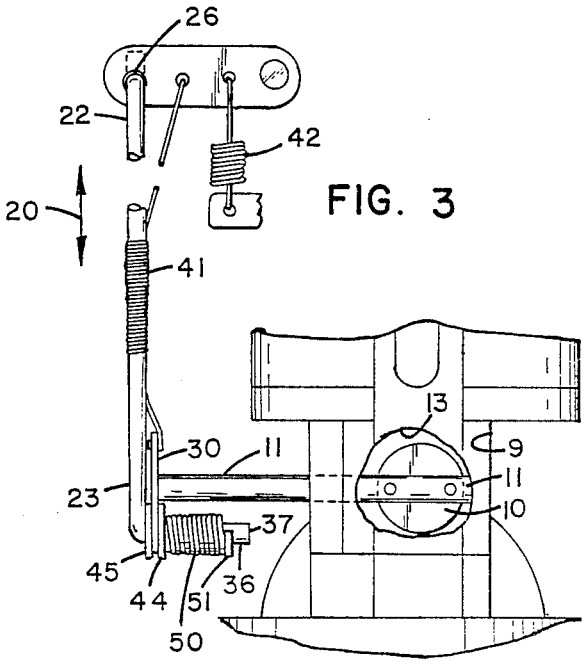
FIG. 3 comprises an enlarged, fragmentary top plan view of a portion of the arrangement shown in FIG. 1, taken generally from the perspective of line 3—3, FIG. 2, with portions broken away to show internal detail.

Referring to FIG. 3, the throttle plate 10 of the preferred embodiment is pivotally mounted by rod 11. As rod 11 is pivoted, the throttle plate 10 re-orients to open or close, selectively, passageway 13, resulting in selective control and adjustment of engine speed.

By a conventional means or system, not detailed, the governor system 5 responds to changes in engine speed to cause an automatic adjustment in the throttle assembly 9, for the preferred embodiment by rotation of the throttle rod 11 to pivot the throttle plate 10. In general, this involves utilization of a governor sensor system or mechanism not detailed, so that the governor system 5 appropriately responds to changes in engine speed. A typical mechanism for such a sensor system in a fly weight ball or flyball system, mounted on or in association with the engine crankshaft or driveshaft. Such a system operates with respect to rotational forces, to move a governor member such as pivotable governor arm 16, predictably, in response to variations in engine speed.

The governor member or arm 16, of the preferred embodiment, is mounted on or in association with the engine block to pivot about an axis defined by axle 17, again controllably and predictably in response to changes in engine speed detected by the governor sensing system. For the preferred embodiment described and shown, the governor arm 16 is mounted on a substantially vertical axle 17, however a variety of physical arrangements can be used.

For the embodiment of FIG. 1, arm 16 provides a link to the remainder of the governor link mechanism including another governor member, preferably governor rod 18. As arm 16 pivots about the axis defined by axle 17, governor rod 18 is driven substantially longitudinally, in the directions generally shown by double-headed arrow 20, FIG. 1.

For the preferred embodiment, governor rod 18 is circular in cross-section and comprises an elongate extension of material such as steel or aluminum. Governor rod 18 includes first and second end portions 22 and 23, respectively.

Figure 2:
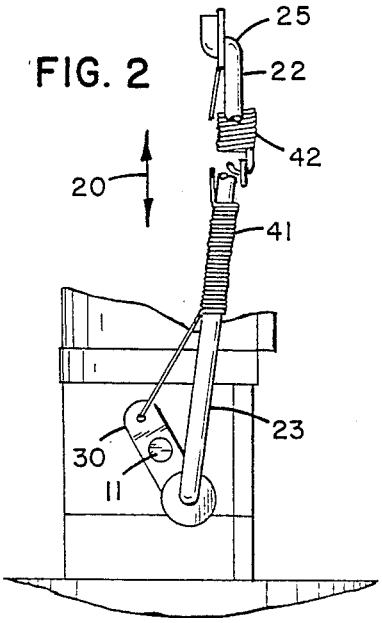
FIG. 2 comprises an enlarged, fragmentary, side elevational view of a portion of the invention depicted in FIG. 1, taken generally from the point of view of line 2—2.

Referring to FIGS. 2 and 3, the first end portion 22 includes means for engaging governor arm 16. A preferred method of engagement is by the passage of a twist or bend 25 in end portion 22 through an aperature 26 in governor arm 16. By this conventional arrangement, a secure, yet pivotable, engagement is provided between flat elongated governor arm 16 and round elongate governor rod 18.

The second end portion 23 of the governor rod 18 includes means for engagement with the throttle control system 6. Referring to FIGS. 1 and 2, the throttle pivot rod 11 includes a crank arm 30 non-pivotally mounted thereon. The crank arm 30 includes an extension 31, FIG. 4, with an aperture 32 therethrough. The second end 23 of the preferred governor rod 18 comprises a bend 35 defining a lateral extension or projection 36 and tip 37 which extend through aperture 32, FIG. 4. Referring to FIG. 2, as rod 18 moves in the directions of double-headed arrow 20, crank arm 30 is pivoted, rotating axle 11 to manipulate throttle plate 10.

Main governor spring 41 operates in a conventional manner to maintain a desired physical orientation of the overall governor throttle link system assembly, which comprises governor arm 16, governor rod 18 and crank arm 30. Generally, the spring 41 operates in opposition to the governor sensor, to maintain a steady engine rate and prevent the system from going into wide-open throttle. It will be understood that crank arm 30 and axle 11 need not provide for a direct mechanical conection between governor rod 18 and the throttle plate 10. Rather, further mechanical linkages may be used.

Figure 5:
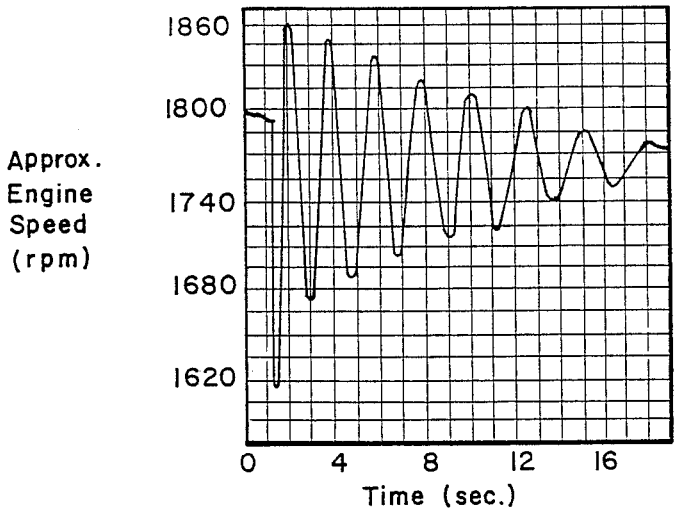
FIG. 5 is a graphic representation of searching in a prior art system, under ¼ rated load.
Figure 6:
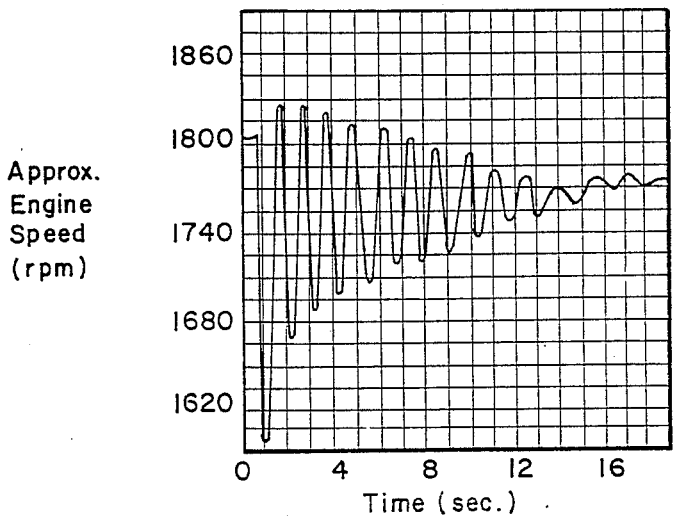
FIG. 6 is a graphic representation of searching in a prior art system, under ½ rated load.

As thus far described, the system comprises a conventional governor system or assembly. The strip charts illustrated in FIGS. 5 and 6 represent operation of such a system, and searching or hunting which may result. Referring to FIG. 5:

The chart of FIG. 5 illustrates hunting or searching of an engine which has been set for a constant speed, in an engine/generator set; the set having a load applied thereto. For example, the engine/generator set may comprise a six kilowatt generator, with the engine speed set, desirably, at about 1,800 rpm. The strip of FIG. 5 generally show the behavior of the system, when placed under about one quarter load, i.e., for a 6 kw rating a 1.5 kw load. The space between each vertical line represents about one second of passed time, the space between each horizontal line representing about a 15 rpm change in engine speed. For the example illustrated in FIG. 5, within the first two seconds after an applied one quarter of rated load, the engine speed dropped from 1,800 rpm to about 1,620 rpm. The governor system then over-compensated within the next second or so, to bring the engine speed to about 1,860 rpm. The governor system then over-compensated to the negative, bringing the engine speed to about 1,680 rpm at about three seconds. As in understood by reference to FIG. 5, generally searching or hunting resulted in a passage of the engine speed through a plurality of maxima and minima, for the example about 8 maxima and 8 minima, until a relatively steady speed was obtained.

FIG. 6 generally represents an undampened system in which about one-half of the rated load was applied. For example, if the generator rated load was about 6 kw, about 3 kw of power drain was applied. Again, it is seen that the governor hunted or searched, in response to the power drain, to find the appropriate engine speed.

Figure 7:
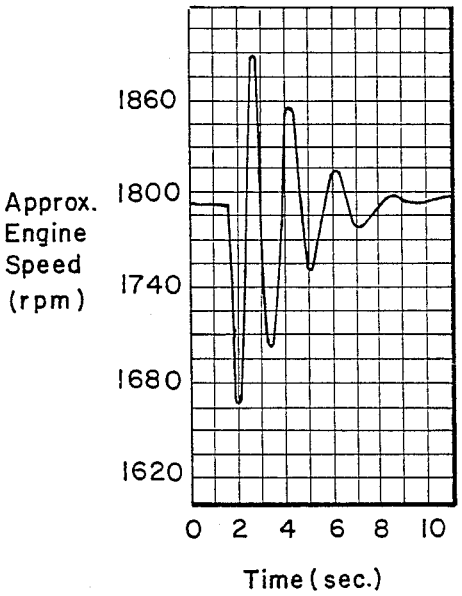
FIG. 7 is a graphic representation illustrating damping of searching in a system according to the present invention, and under ¼ rated load.

FIG. 7 represents a system generally analogous to FIG. 5, but including a friction damper according to the present invention. It is readily seen from FIG. 7 that under a strain of one-quarter of the rated load, the governor assembly relatively rapidly returned the engine to approximately the set speed, with passage through only relatively few maxima and minima before a steady engine speed was obtained.

Figure 8:
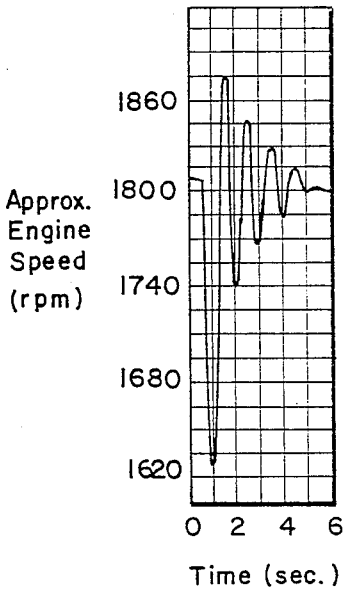
FIG. 8 is a graphic representation illustrating a damping of searching in a system according to the present invention and under ½ rated load.

Similarly, FIG. 8 is analogous to FIG. 6, but with the introduction of a damper system according to the present invention into the mechanism. It is readily seen that under one-half of the rated load, the governor assembly rapidly returned the engine speed to the rated level, again with passage through only relatively few maxima and minima.

The preferred friction damper according to the present invention is introduced into the system at the joint between the governor rod 18 and the crank arm 30 that controls adjustment of the throttle 6. This is readily understood by reference to FIG. 4.

Figure 4:
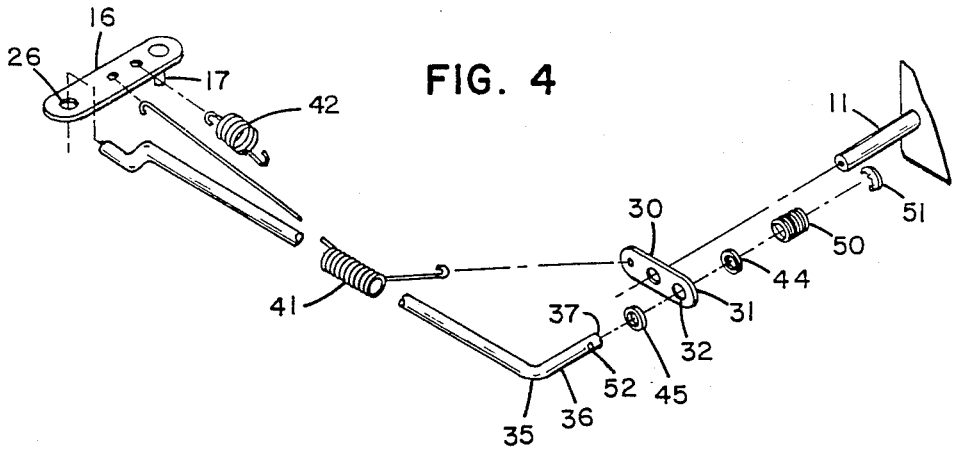
FIG. 4 is an exploded, fragmentary, perspective view of a portion of the invention depicted in FIG. 1, showing components of a friction damper mechanism according to the present invention.

In FIG. 4, a friction washer plate or member mechanism is illustrated. The mechanism includes a first washer member 44 mounted upon extension 36 in rod 18, to press against or toward the crank arm 30. Friction washer member 44 is biased toward the crank arm 30 and a portion of the governor rod 18, specifically bend 35, under spring pressure, to squeeze the crank arm 30 between the washer 44 and bend 35 and provide resistance to pivoting of the end portion 23 of the governor rod 18 with respect to the end 31 of the crank arm 30. It will be understood that if there is resistance to this pivoting, there is generally a damping of crank arm 30 movement. In the preferred embodiment, the friction washer mechanism includes two friction washer members 44 and 45, positioned on opposite sides of crank arm 30.

Biasing of the friction washer members 44 and 45 toward one another, to generate desired friction, will be understood by reference to FIGS. 3 and 4. Generally, washer member 45 presses up against bend 35. Washer member 44 is positioned on the opposite side of crank arm 30 and is biased thereagainst by a biasing means comprising spring 50. Spring 50 is maintained in position by a conventional retainer member, such as a clip 51 which can mate with a groove 52 in rod 18.

While a variety of spring mechanisms may be utilized, it has been found that a conventional stainless steel spring applying between one and three pounds, and preferably about two pounds, of force against friction washer 44, is desired for most applications. It will also be understood that friction washer members 44 and 45 may be constructed from a variety of materials. Conventional copper washers have been found to operate quite effectively.

The preferred embodiment has been illustrated with a spring directing force toward the major portion of the governor rod. It will be understood that in some applications an opposite arrangement may be desired. Also, for simplicity the preferred embodiment is illustrated with friction being generated between a bend in the governor rod and a washer member 44, with the crank arm therebetween. In alternate embodiments, the governor rod may include a projection such as a post or flange thereon, or similar structure, against which or toward which the washer member and biasing means presses the crank arm. It will be understood that as a result of the bend, the main portion of the governor rod itself provides a projection against which pressure is directed, to provide the desired friction.

From the above descriptions, it will be understood that the present invention generally includes a method for the reduction of hunting or searching in a governor controlled engine/generator set through the introduction of a friction damper into the system, most preferably at a connection between a governor mechanism and a throttle control. A specific preferred arrangement utilizing a governor rod with a bend therein, a pair of friction washers, a compression spring and a crank arms is disclosed. As a result of the introduction of the friction damper mechanism into a conventional governor assembly, searching is reduced, FIGS. 7 and 8, since throttle adjustment is inhibited somewhat. The present invention may be installed with appropriate modifications in a variety of conventional governor systems, to control over-compensation and searching.

It is to be understood that while certain embodiments of the present ivention have been illustrated and described, the invention is not to be limited to the specific forms or arrangement of parts herein described and shown.

What is claimed is:

1. A dampened governor mechanism for selectively adjusting a speed of an associated engine in response to variations in engine load, the engine including a throttle control; said dampened governor mechanism comprising:

(a) a crank arm constructed and arranged to selectively adjust the throttle control, for accelerating and decelerating the engine; said crank arm comprising a link having a first end portion with an aperture therein;

(b) a governor rod mechanism including a governor member; said governor member comprising a governor rod including an end portion with a lateral extension projecting through said crank arm first end aperture; said governor rod being constructed and arranged to adjust a rotational orientation of said throttle control, as selected;

(c) means for detecting variations in engine speed and adjusting a position of said governor rod in response thereto, in a manner selectively accelerating and decelerating the engine as necessary to substantially maintain a desired engine speed; and, (d) a friction damper mechanism constructed and arranged to provide selected, operable, resistance to movement of said crank arm by said governor rod; said friction damper mechanism including: a first friction washer member; and, a biasing member;

(i) said first friction washer member and said crank arm being biased toward one another by said biasing member;

(ii) said biasing member being mounted on said governor rod and being operatively positioned so that pressure of said biasing member against said first friction washer member generates selected frictional resistance to movement of said crank arm by said governor rod; said selected friction inhibiting searching of the governor mechanism for a desired speed, in response to varying loads placed on the engine.

2. A governor mechanism according to claim 1 wherein:

(a) said governor rod end portion includes a bend therein; said bend defining said lateral extension, and said lateral extension having a tip;

(b) said first friction washer member is positioned on said governor rod end portion between said tip and said crank arm;

(c) said damper mechanism includes a second washer member positioned on said governor rod end portion between said crank arm and said bend; and, (d) said biasing member being oriented to force said second washer member and said first washer member together, with said crank arm therebetween.

3. The governor mechanism according to claim 2 wherein:

(a) said biasing member comprises a spring mounted on said governor rod end portion.

4. The governor mechanism according to claim 3 wherein said spring is constructed and arranged to apply a force of between one and three pounds against said first washer member.

5. The governor mechanism according to claim 1 wherein:

(a) said biasing member comprises a spring mounted on said governor rod end portion.

6. The governor mechanism according to claim 5 wherein said spring is constructed and arranged to apply a force of between one and three pounds against said first washer member.

7. A dampened governor mechanism for selectively adjusting a speed of an associated engine in response to variations in engine load, the engine including a throttle control; said dampened governor mechanism comprising:

(a) a crank arm constructed and arranged to selectively adjust the throttle control, for accelerating and decelerating the engine; said crank arm having a first end portion;

(b) a governor rod mechanism including a governor member; said governor member comprising a governor rod including an end portion with a lateral extension; said governor rod lateral extension rotatably engaging said crank arms first end portion; said governor rod being constructed and arranged to adjust a rotational orientation of said throttle control, as selected;

(c) means for detecting variations in engine speed and adjusting a position of said governor rod in response thereto, in a manner selectively accelerating and decelerating the engine as necessary to substantially maintain a desired engine speed; and, (d) a friction damper mechanism constructed and arranged to provide selected, operable, resistance to movement of said crank arm by said governor rod; said friction damper mechanism including a first friction washer member, and a biasing member;

(i) said first friction washer member and said crank arm being biased toward one another by said biasing member;

(ii) said biasing member being mounted on said governor rod and being operatively positioned so that pressure of said biasing member against said first friction washer member generates selected frictional resistance to movement of said crank arm by said governor rod; said selected friction inhibiting searching of the governor mechanism for a desired speed in response to varying loads placed on the engine.

8. A governor mechanism according to claim 7 wherein:

(a) said governor rod end portion includes a bend therein, said bend defining said lateral extension, and said lateral extension having a tip;

(b) said first friction member is positioned on said governor rod end portion between said tip and said crank arm;

(c) said damper mechanism includes a second washer member positioned on said governor rod end portion between said crank arm and said bend; and, (d) said biasing member being oriented to force said second washer member and said first washer member together, with said crank arm therebetween.

9. The governor mechanism according to claim 8 wherein:

(a) said biasing member comprises a spring mounted on said governor rod end portion.

10. The governor mechanism according to claim 9 wherein said spring is constructed and arranged to apply a force of between one and three pounds against said first washer member.

11. The governor mechanism according to claim 7 wherein:

(a) said biasing member comprises a spring mounted on said governor rod end portion.

12. The governor mechanism according to claim 11 wherein said spring is constructed and arranged to apply a force of between one and three pounds against said first washer member.

13. A dampened governor mechanism for selectively adjusting a speed of an associated engine in response to variations in engine load, the engine including a throttle control; said dampened governor mechanism comprising:

(a) a crank arm constructed and arranged to selectively adjust the throttle control for accelerating and decelerating the engine; said crank arm comprising a link having a first end portion with an aperture therein;

(b) a governor rod mechanism including a governor member; said governor member comprising a governor rod including an end portion with a lateral extension projecting through said crank arm first end aperture; said governor rod being constructed and arranged to adjust a rotational orientation of said throttle control, as selected;

(c) means for detecting variations in engine speed and adjusting a position of said governor of said governor rod in response thereto, in a manner selectively accelerating and decelerating the engine as necessary to substantially maintain a desired engine speed; and, (d) a friction damper mechanism constructed and arranged to provide selected, operable, resistance to movement of said crank arm by said governor rod; said friction damper mechanism including a first friction washer member; and, a biasing member;

(i) said first friction washer member and said crank arm being biased relative to one another by said biasing member;

(ii) said biasing member being mounted on said governor rod and being operatively positioned so that pressure of said biasing member against said first friction washer member generates selected frictional resistance to movement of said crank arm by said governor rod; said selected friction inhibiting searching of the governor mechanism for a desired speed, in response to varying loads placed on the engine.

14. A governor mechanism according to claim 13 wherein:

(a) said governor rod end portion includes a bend therein, said bend defining said lateral extension and said lateral extension having a tip;

(b) said first friction washer member is positioned on said governor rod end portion between said tip and said crank arm;

(c) said damper mechanism includes a second washer member positioned on said governor rod end portion between said crank arm and said bend; and, (d) said biasing member being oriented to force said second washer member and said first washer member together, with said crank arm therebetween.

15. The governor mechanism according to claim 14 wherein:

(a) said biasing member comprises a spring mounted on said governor rod end portion.

16. The governor mechanism according to claim 14 wherein said spring is constructed and arranged to apply force of between one and three pounds against said first washer member.

17. The governor mechanism according to claim 13 wherein:

(a) said biasing member comprises a spring mounted on said governor rod end portion.

18. The governor mechanism according to claim 16 wherein said spring is constructed and arranged to apply a force of between one and three pounds against said first washer member.

19. A dampened governor mechanism for selectively adjusting a speed of an associated engine in response to variations in engine load, the engine including a throttle control; said dampened governor mechanism comprising:

(a) a crank arm constructed and arranged to selectively adjust the throttle control, for accelerating and decelerating the engine; said crank arm having a first end portion;

(b) a governor rod mechanism including a governor member; said governor member comprising a governor rod including an end portion with a lateral extension; said governor rod lateral extension rotatably engaging said crank arm first end portion; said governor rod being constructed and arranged to adjust a rotational orientation of said throttle control, as selected;

(c) means for detecting variations in engine speed and adjusting a position of said governor rod in response thereto, in a manner selectively accelerating and decelerating the engine as necessary to substantially maintain a desired engine speed; and, (d) a friction damper mechanism constructed and arranged to provide selected, operable, resistance to movement of said crank arm by said governor rod; said friction damper mechanism including: a first friction washer member; and a biasing member;

(i) said first friction washer member and said crank arm being biased relative to one another by said biasing member;

(ii) said biasing member being mounted on said governor rod and being operatively positioned so that pressure of said biasing member against said first friction washer member generates selected frictional resistance to movement of said crank arm by said governor rod; said selected friction inhibiting searching of the governor mechanism for a desired speed, in response to varying loads placed on the engine.

20. A governor mechanism according to claim 19 wherein:

(a) said governor rod end portion includes a bend therein, said bend defining said lateral extension, and said lateral extension having a tip;

(b) said first friction washer member is positioned on said governor rod end portion between said tip and said crank arm;

(c) said damper mechanism includes a second washer member positioned on said governor rod end portion between said crank arm and said bend; and, (d) said biasing member being oriented to force said second washer member and said first washer member together, with said crank arm therebetween.

21. The governor mechanism according to claim 2 wherein:

(a) said biasing member comprises a spring mounted on said governor rod end portion.

22. The governor mechanism according to claim 20 wherein said spring is constructed and arranged to apply a force of between one and three pounds against said first washer member.

23. The governor mechanism according to claim 20 wherein:

(a) said biasing member comprises a spring mounted on said governor rod end portion.

24. The governor mechanism according to claim 21 wherein said spring is constructed and arranged to apply a force of between one and three pounds against said first washer member.

25. A dampened governor mechanism for selectively adjusting a speed of an associated engine in response to variations in engine load, the engine including a throttle control; said dampened governor mechanism comprising:

(a) a crank arm constructed and arranged to selectively adjust the throttle control, for accelerating and decelerating the engine; said crank arm having a first end portion;

(b) a governor rod mechanism including a governor member; said governor member comprising a governor rod including an end portion with a lateral extension; said governor rod lateral extension rotatably engaging said crank arm first end portion; said governor rod being constructed and arranged to adjust a rotational orientation of said throttle control, as selected;

(c) means for detecting variations in engine speed and adjusting a position of said governor rod in response thereto, in a manner selectively accelerating and decelerating the engine as necessary to substantially maintain a desired engine speed; and, (d) a friction damper mechanism constructed and arranged to provide selected, operable, resistance to movement of said crank arm by said governor rod; said friction damper mechanism including a first friction washer member, and a biasing member;

(i) said first friction washer member and said crank arm being biased toward one another by said biasing member;

(ii) said biasing member being mounted on said governor rod and being operatively positioned so that pressure of said biasing member generates selected frictional resistance to movement of said crank arm by said governor rod due to frictional engagement of said friction washer with part of said governor mechanism; said selected friction inhibiting searching of the governor mechanism for a desired speed in response to varying loads placed on the engine.

26. A dampened governor mechanism for selectively adjusting a speed of an associated engine in response to variations in engine load, the engine including a throttle control; said dampened governor mechanism comprising:

(a) a crank arm constructed and arranged to selectively adjust the throttle control, for accelerating and decelerating the engine; said crank arm having a first end portion;

(b) a governor rod mechanism including a governor member; said governor member comprising a governor rod including an end portion with a lateral extension; said governor rod lateral extension rotatably engaging said crank arm first end portion; said governor rod being constructed and arranged to adjust a rotational orientation of said throttle control, as selected;

(c) means for detecting variations in engine speed and adjusting a position of said governor rod in response thereto, in manner selectively accelerating and decelerating the engine as necessary to substantially maintain a desired engine speed; and, (d) a friction damper mechanism constructed and arranged to provide selected, operable, resistance to movement of said crank arm by said governor rod; said friction damper mechanism including: a first friction washer member; and, a biasing member;

(i) said first friction washer member and said crank arm being biased relative to one another by said biasing member;

(ii) said biasing member being mounted on said governor rod and being operatively positioned so that pressure of said biasing member generates selected frictional resistance to movement of said crank arm by said governor rod due to frictional engagement of said friction washer with a portion of said governor mechanism; said selected friction inhibiting searching of the governor mechanism for a desired speed, in response to varying loads placed on the engine.

* * * * *